United States Patent [19]

Smith et al.

[11] Patent Number: 4,517,689

[45] Date of Patent: May 21, 1985

[54] TOILET SEAT

[76] Inventors: John T. Smith, 230 Barry Ave. S., Minneapolis, Minn. 55391; John R. Smith, 5401 Cambridge Ave., St. Louis Park, Minn. 55426

[21] Appl. No.: 356,832

[22] Filed: Mar. 10, 1982

[51] Int. Cl.[3] ..... A47K 13/26; A47K 13/12

[52] U.S. Cl. ..... 4/235

[58] Field of Search ..... 4/234–240

[56] References Cited

U.S. PATENT DOCUMENTS

| | | | |
|---|---|---|---|
| 426,287 | 4/1890 | Larkin . | |
| 548,367 | 10/1895 | High | 4/235 |
| 1,701,114 | 2/1929 | McKinney, Jr. . | |
| 1,990,869 | 2/1935 | Joyce . | |
| 2,171,581 | 9/1939 | Mallory | 4/234 |
| 2,738,518 | 3/1956 | Niemann | 4/239 |
| 2,980,922 | 4/1961 | Taylor . | |
| 3,210,777 | 10/1965 | Katoch . | |
| 4,213,211 | 7/1980 | Bemis . | |

FOREIGN PATENT DOCUMENTS

| | | | |
|---|---|---|---|
| 280982 | 2/1914 | Fed. Rep. of Germany | 4/235 |

OTHER PUBLICATIONS

Samaritan Seats "L" from Benneke Corporation.

Samaritan Lifts (Solid Plastic Toilet Seat for Handicapped) Specification, Beneke (R) Publication No. H-4.

*Primary Examiner*—Charles E. Phillips

*Attorney, Agent, or Firm*—Merchant, Gould, Smith, Edell, Welter & Schmidt

[57] ABSTRACT

A toilet seat (12) usable for both handicapped and non-handicapped users is disclosed. A seat (20) is pivotally positioned atop seat (18) which in turn is pivotally connected to the toilet (14) by base member (16). The toilet seat may operate as an elevated seat with seat (20) in horizontal position or a standard elevation seat with seat (20) and vertical position, or, for cleaning, with both seats in a vertical position.

6 Claims, 5 Drawing Figures

18
64
40
40
40
5
5
26
64
44
60
40
16
24
22
64
40
42
60
62
18
12
20
14

64
20
40
18
62
40
60
12
68
44
66
26
16
44
76
38
28
60
62
40
40
20
18
64
14

TOILET SEAT

TECHNICAL FIELD

This invention relates to the field of improvements in toilet seats, in particular, improvements relating to adaptation of toilets for handicapped users.

BACKGROUND OF THE INVENTION

The standard conventional water closet or toilet bowl installed in the United States has a toilet seat affixed thereon which brings the seating height to approximately 40 centimeters from the floor. This is considered acceptable for the majority of people. Handicapped persons, however, have difficulty using a toilet at this height and require an additional elevation of about ten centimeters. Numerous toilet elevator devices have been invented specifically for the purpose of adapting standard toilet bowls to the additional height requirement for handicapped users. (See, for example, U.S. Pat. No. 2,980,922 issued to Taylor and U.S. Pat. No. 4,213,211 issued to Bemis et al.)

Unfortunately, these elevator devices require that handicapped, as well as non-handicapped users alike, use the toilet at the elevated height. Many non-handicapped users, however, may find this elevated height objectionable.

To solve this problem, the present invention discloses a toilet seat which is convertible from a standard to an elevated height without the need to disassemble any components thereof. Thus, the present invention is capable of serving the needs of both handicapped and non-handicapped users without discomfort.

BRIEF SUMMARY OF THE INVENTION

The present invention is directed to a toilet seat usable by handicapped as well as non-handicapped persons. The seat includes a base member mountable on a toilet bowl, a first seat member pivotally attached to the base member, and a second seat member thicker than the first seat member operatively connected to the base member for pivoting from an upright to a horizontal position atop the first seat member so that the effective toilet seat height can be changed from a standard height to a handicapped height by pivoting of the second seat member. According to a further aspect of the invention, the first seat member has a major portion generally shaped so as to rest upon and be supported by the toilet bowl and having a minor portion extending generally upwardly from the major portion toward the peripheral edge thereof, the minor portion including a pair of spaced apart risers, each having a first and second generally horizontally disposed apertures one above the other. Means are provided for pivoting of the first seat member on the base member and the second seat member on the first seat member.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter in which there are illustrated and described preferred embodiments of the invention.

BRIEF DESCRIPTION OF THE DRAWINGS

In the drawings, wherein like reference numerals refer to like elements throughout the several views.

DETAILED DESCRIPTION OF THE INVENTION

Figure 2:
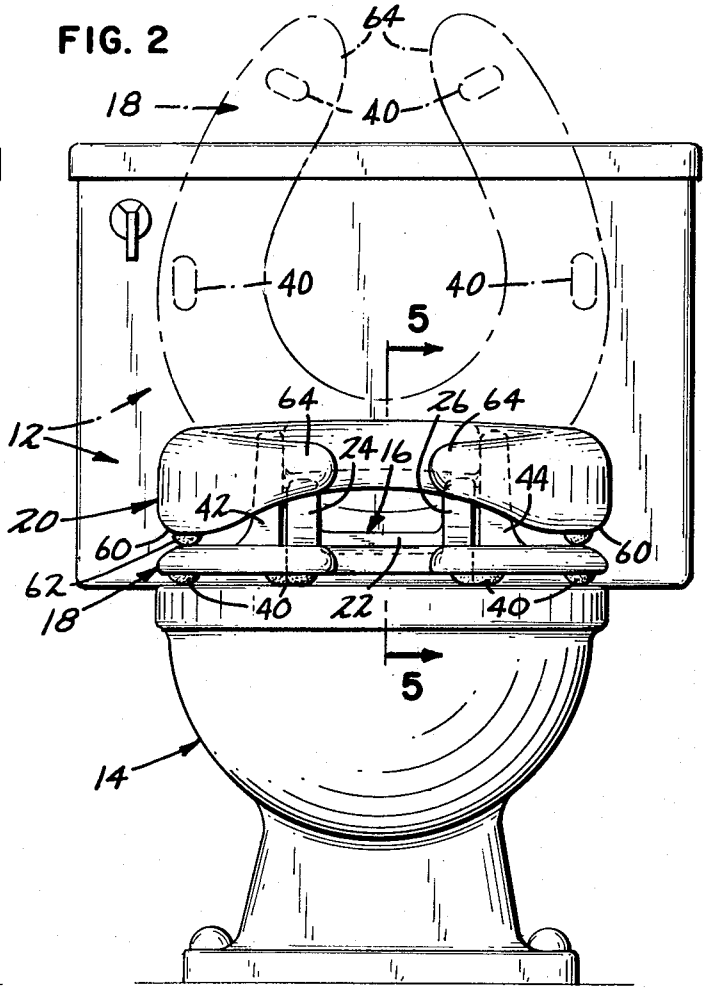
FIG. 2 is a front elevational view of the subject matter in FIG. 1.
Figure 1:
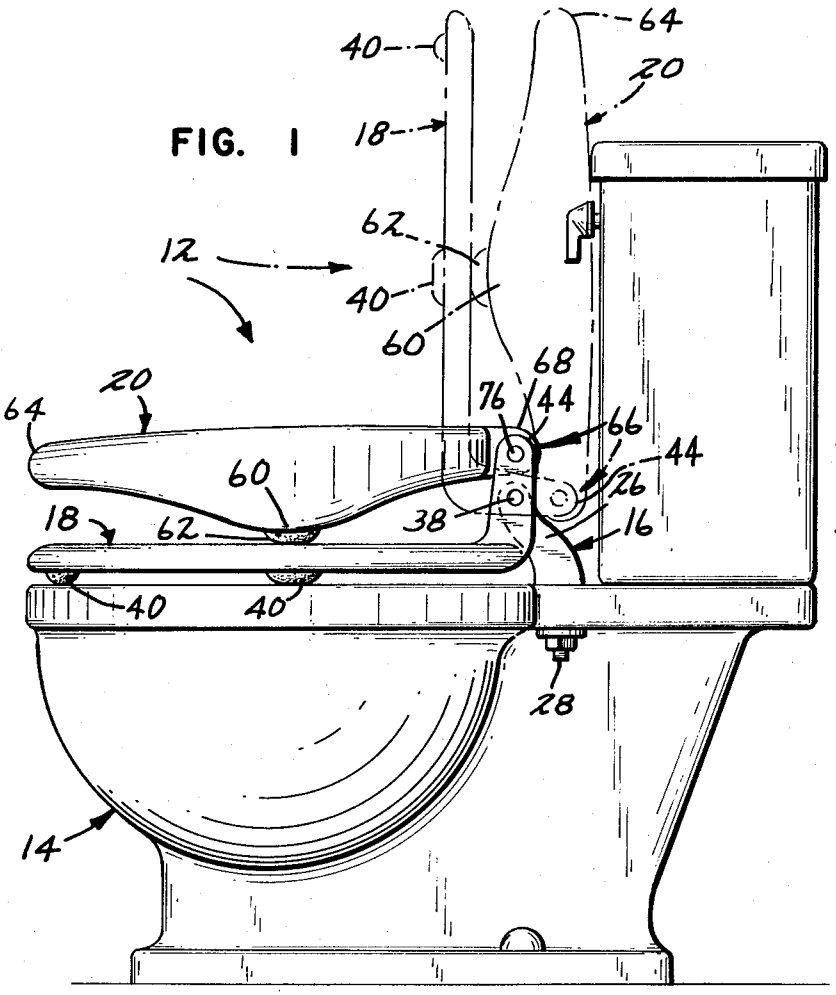
FIG. 1 is a side elevational view of an embodiment of the present invention shown attached to a standard toilet bowl.
Figure 3:
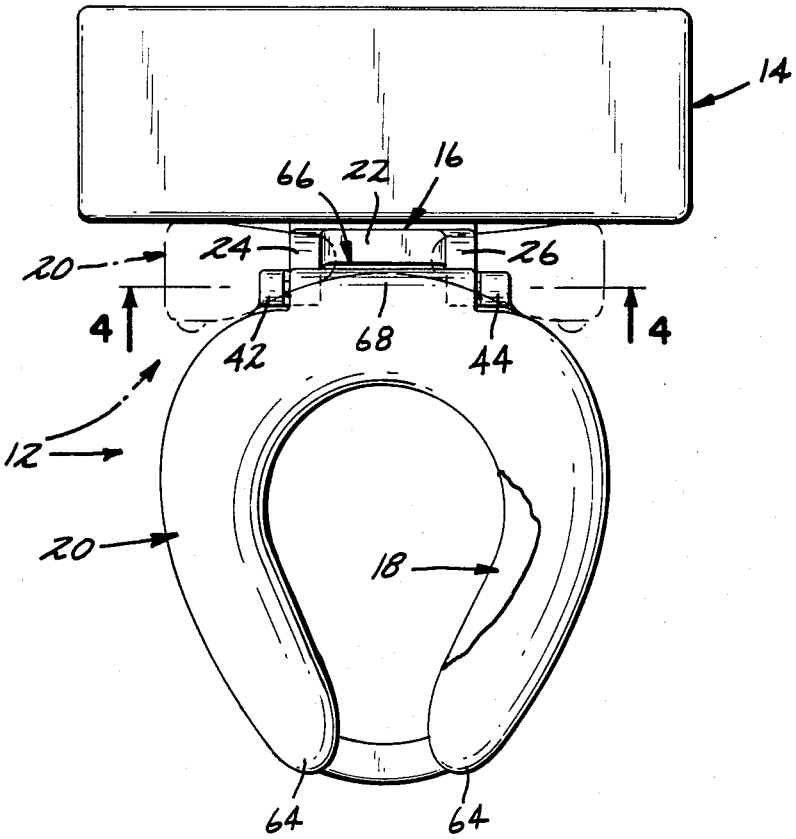
FIG. 3 is a top plan view of the subject matter in FIG. 1.

The embodiment of the invention shown in FIGS. 1, 2 and 3 comprise a toilet seat 12 convertible for use with handicapped and non-handicapped users, affixed to a standard toilet bowl or water closet 14. Seat 12 includes three main general components, a base member 16, a first seat 18, and a second seat 20.

The base member 16 preferably includes a planar member 22 (see FIG. 4) and two side portions 24, 26, extending upward therefrom at the peripheral ends of the planar member 22. Planar member 22 is affixed to the toilet bowl 14 by means of fasteners 28 which pass through apertures 30 and 32 commonly found in toilet bowls which typically have a 14 centimeter center-to-center hole spacing. The fasteners 28 are preferably molded within planar member 22 on its bottom face; however, alternate means such as slotting of the base member or countersinking holes therethrough may be employed. Side members 24 and 26 are preferably cantilevered as shown in FIG. 5 such that they are angled forward sufficiently to allow clearance of the second seat member 20 when in its storage or vertical position, as will be explained hereinafter.

Figure 4:
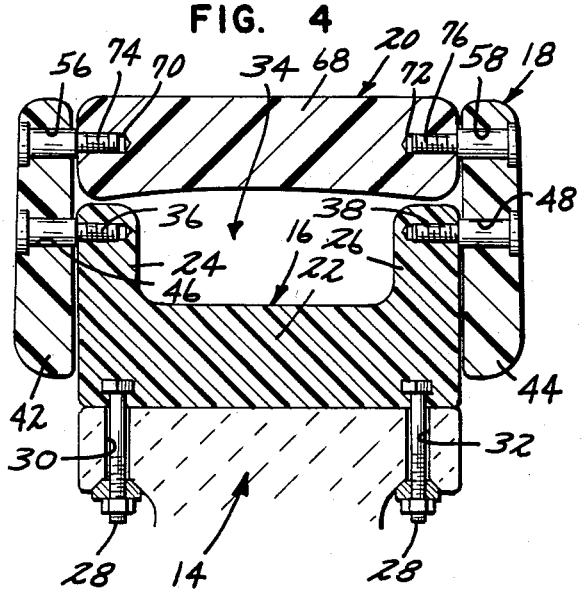
FIG. 4 is a sectional view taken generally along lines 4—4 in FIG. 3.
Figure 5:
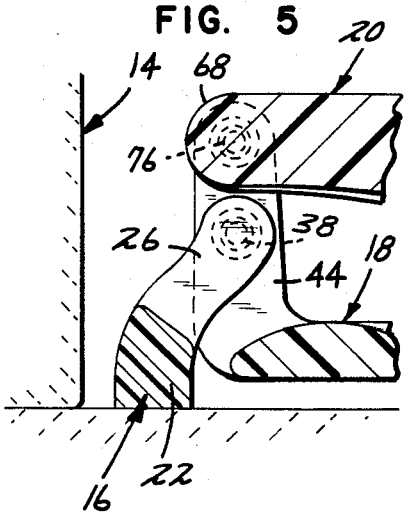
FIG. 5 is a sectional view taken along lines 5—5 in FIG. 2.

It is noted that in the preferred embodiment, side portions 24 and 26 extend vertically beyond the planar surface member 22, leaving what appears as a trough portion 34 therein as seen in FIG. 4.

Extending substantially horizontally outwardly from side portions 24 and 26 are pivot pins 36 and 38 which are preferably threaded into borings inside portions.

First seat member 18 is formed of a substantially U-shaped seat section which is supported on the toilet bowl feet 40 on the bottom surface. At the closed end of the U-shaped seat, there are extending substantially orthogonally from the planar portion, a pair of spaced minor members or risers 42 and 44. The spacing between said members 42 and 44 is sufficient to accommodate the distance between members 24 and 26. Approximately midway in the length of portions 42 and 44 are apertures 46 and 48 through which pivot pins and 36 and 38 pass. These pins may have heads and may be in the form of bolts which are threaded into members 24 and 26. Sufficient clearance is provided in apertures 46 and 48 to permit seat 18 to pivot at these points from a substantially horizontal first position to a substantially vertical second position as shown in FIGS. 1 and 2.

Members 42 and 44 also include a second set of apertures 56 and 58 parallel with 46 and 48 located toward the distant end thereof.

Second seat member 20 includes a substantially flat top surface, which may be contoured for comfort. In the preferred embodiment, the thickness of seat 20 increases over its length to a maximum located at the midpoint 60 where a pair of feet 62 are located, and thereafter decreases to a minimum at its distant end. This decreasing thickness creates a concave contour or depression on the bottom surface thereof (see FIG. 2) which provides back clearance for the user of seat 18 when the seats are in the position shown in FIG. 3 with seat 18 horizontal and seat 20 vertically oriented. Seat 20 is similarly shaped like seat 18 in a U-shaped form and is tapered toward its open ends 64, as shown in FIG. 2. At end 66 of seat 20, there is a flanged section 68 extending therefrom which has a span slightly less than that of the distance between members 42 and 44 so that it may be located therebetween. Flange 68 includes borings 70 and 72 for receiving pivot pins 74 and 76, which pass through apertures 56, 58 into said borings. The pivot pins are in the same nature as 36 and 38 and borings 70 and 72 are designed to permit seat 20 to pivot with respect to members 42 and 44. Apertures 56, 58 are located on members 42 and 44 sufficiently distant from apertures 46, 48 so that flange 68 will not encounter members 24 or 26 when pivoted from a horizontal to a vertical position.

It is preferable to construct all portions of this device, excepting pivot pins and mounting bolts out of a substantially nonhygroscopic material or similar. In a preferred embodiment, injection molded high impact polystyrene is preferred. The pivot pins and mounting bolts are preferably stainless steel with nylon nuts and washers.

OPERATION

To accommodate non-handicapped users, the second seat 20 is lifted from its horizontal position to vertical while first seat 18 is maintained in its original position. Seat 20 can be maintained in a vertical position in one of several ways, first, members 24 and 26 can be sufficiently cantilevered so as to insure that the center of gravity of seat 20 will cause it to fall toward the water tank rather than back onto seat 18. Alternatively, the pivoting system can be made friction sufficient so as to maintain the seat in any position including intermediate positions between the horizontal and the vertical. Finally, seat 20 can be molded such that it has substantially more weight on the upper surface than the lower surface thereby having a center of gravity which will tend to cause it to fall toward the water tank and thus remain vertical.

A handicapped user would employ seat 20 atop seat 18 to attain the additional height.

For cleaning, both seats 20 and 18 can be raised to their vertical positions as shown in phantom lines in FIGS. 1, 2 and 3. Again, any of the above means may be employed to maintain the two seats in their vertical position and prevent them from falling to their horizontal position. Preferably, the weight ratio of seat 20 to 18 is such that seat 20 will be substantially heavier and therefore cause the center of gravity to be located back of pivot pins 36 and 38 (i.e. toward the water tank) thereby insuring stability.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent of the broad general meaning of the terms in which the appended claims are expressed.

I claim:

1. A toilet seat for attachment to a toilet bowl comprising:

(A) a base member having a bottom, a pair of generally parallel side portions extending upwardly from said bottom and a top face between said side portions, said base member including means for attachment to the toilet bowl, and a generally horizontally disposed aperture in each of said side portions;

(B) a first seat member having a major portion generally shaped so as to rest upon and be supported by the toilet bowl, and having a minor portion extending generally upwardly from said major portion at the peripheral edge thereof, said minor portion including a pair of spaced apart risers, each having a first generally horizontally disposed aperture and second generally horizontally disposed aperture thereabove;

(C) means disposed in each of said first apertures of said minor portion and said apertures of said side portions for pivotally fastening said first seat to said base member with said side portions located between said risers;

(D) a second seat member having a top and bottom surface and being pivotally mounted on said risers at said second apertures, said second seat member being capable of pivoting from a generally upright position to a generally horizontal position wherein at least a portion of said bottom surface rests atop said first seat member, and wherein the maximum dimension from said top to bottom surfaces of said second seat member is greater than the thickness of said first seat member, so that when said second seat member is in the horizontal position the effective height of the toilet seat is increased.

2. A toilet seat according to claim 1 wherein said bottom surface of said second seat member includes a gradually outwardly extending surface which can rest upon said first seat member.

3. A toilet seat according to claim 2 wherein said outwardly extending surface is the bottom surface of said second seat member and wherein said bottom surface includes a concave portion which forms a contoured depression when said second seat member is in the upright position.

4. A toilet seat according to claim 1 wherein said second seat member is U-shaped having a discontinuous end and a pivoted end opposite thereof, said second seat member being thicker at points between ends than at said end thereof.

5. A toilet seat according to claim 1 wherein the moment of the portion of said risers from said first to said second apertures taken together with said second seat member is greater than the moment of the remaining portion of said risers from said first aperture along with said major portion, so that said first and second seat members will not fall unaided from their upright position to their horizontal position.

6. A toilet seat according to claim 1 wherein said second seat member includes borings and wherein said first seat member includes pivot members insertable through said second apertures and into said borings to provide pivotal movement of said second seat member relative to said first seat member.

* * * * *